US005901509A

United States Patent [19]

Rose

[11] Patent Number: 5,901,509

[45] Date of Patent: May 11, 1999

[54] COMPONENT FOR A WINDOW FRAME

[76] Inventor: John Edward Rose, 66 Kings Road, Windsor Berks. SL4 2AH., United Kingdom

[21] Appl. No.: 08/749,929

[22] Filed: Nov. 14, 1996

[30] Foreign Application Priority Data

Nov. 17, 1995 [GB] United Kingdom ..... 9523523
Jul. 1, 1996 [GB] United Kingdom ..... 9613781

[51] Int. Cl.[6] ..... E06B 7/14

[52] U.S. Cl. ..... 52/209; 52/204.1; 52/204.5; 52/656.5; 49/504; 49/DIG. 2

[58] Field of Search ..... 52/204.1, 209, 52/656.5, 204.5; 49/504, DIG. 2

[56] References Cited

U.S. PATENT DOCUMENTS

| | | | |
|---|---|---|---|
| 1,572,217 | 2/1926 | Menczer . | |
| 2,066,051 | 12/1936 | Pettit | 49/438 |
| 4,725,324 | 2/1988 | Schmidt . | |
| 4,799,332 | 1/1989 | Haas | 49/504 X |
| 4,924,631 | 5/1990 | Davies et al. | 49/DIG. 2 X |
| 4,944,118 | 7/1990 | Biro | 49/DIG. 2 X |
| 4,967,507 | 11/1990 | Visnic et al. | 49/504 |
| 5,014,466 | 5/1991 | Winner | 49/504 |
| 5,111,621 | 5/1992 | Meyers | 49/504 |

FOREIGN PATENT DOCUMENTS

| | | |
|---|---|---|
| 0083606 | 6/1983 | European Pat. Off. . |
| 0128259 | 12/1984 | European Pat. Off. . |
| 0202510 | 11/1986 | European Pat. Off. . |
| 0298354 | 1/1989 | European Pat. Off. . |
| 0517702 | 12/1992 | European Pat. Off. . |
| 0687783 | 12/1995 | European Pat. Off. . |
| 0695846 | 2/1996 | European Pat. Off. . |
| 1577246 | 11/1967 | France . |
| 2052639 | 5/1972 | Germany . |
| 2912020 | 9/1980 | Germany . |
| 1132595 | 11/1968 | United Kingdom . |
| 1492931 | 1/1975 | United Kingdom . |
| 1403520 | 8/1975 | United Kingdom . |
| 2082234 | 8/1980 | United Kingdom . |
| 2074716 | 11/1981 | United Kingdom . |
| 2084230 | 4/1982 | United Kingdom . |
| 2106575 | 4/1983 | United Kingdom . |
| 2112435 | 7/1983 | United Kingdom . |
| 2138058 | 10/1984 | United Kingdom . |
| 2138060 | 10/1984 | United Kingdom . |
| 2147646 | 5/1985 | United Kingdom . |
| 2155087 | 9/1985 | United Kingdom . |
| 2169637 | 7/1986 | United Kingdom . |
| 2178096 | 2/1987 | United Kingdom . |
| 2190416 | 11/1987 | United Kingdom . |
| 2202888 | 10/1988 | United Kingdom . |
| 2206630 | 1/1989 | United Kingdom . |
| 2263495 | 7/1993 | United Kingdom . |
| 2282401 | 4/1995 | United Kingdom . |
| 2283269 | 5/1995 | United Kingdom . |
| 2284003 | 5/1995 | United Kingdom . |
| WO 95/27119 | 10/1995 | WIPO . |

OTHER PUBLICATIONS

U.K. Patent Office Search, GB9613781.5.

*Primary Examiner*—Christopher Kent
*Attorney, Agent, or Firm*—Watts, Hoffmann, Fisher & Heinke Co., L.P.A.

[57] ABSTRACT

A component for a window frame includes a first elongate member having an open side and a second elongate member. The second elongate member is attachable to the first elongate member at the open side. This defines with said first elongate member a closed space within said component. The component also includes ventilating apertures.

12 Claims, 7 Drawing Sheets

COMPONENT FOR A WINDOW FRAME

FIELD OF THE INVENTION

This invention relates to components for window frames. In particular, but not exclusively, this invention relates to a component for a window frame for a sash window. More particularly, this invention relates to a window frame for a sliding sash window.

DESCRIPTION OF THE PRIOR ART

In the construction of traditional sash window frames, the frame members are of a box section and define spaces in which the counter balance weights can move up and down. Traditional such window frames are made of timber and, to obtain access to the weights, it is necessary to cut a hole in one of the sides.

BRIEF DESCRIPTION OF THE INVENTION

According to one aspect of this invention there is provided a component for a window frame comprising a first elongate member having an open side, and a second elongate member attachable to the first elongate member at said open side to define with said first elongate member a closed space within said component.

Preferably, the first elongate member includes first and second opposite side walls, and a rear wall from which the side walls extend, the walls being arranged such that the open side is opposite the rear wall.

The first elongate member may further include a central elongate member extending from said rear wall to a position adjacent to, or in contact with, the second member when the second member is attached to the first member. Preferably, the side walls are substantially parallel to each other. The central member may be substantially parallel to at least one of the side walls.

The component is preferably provided with co-operating formations to attach the first member to the second member.

The co-operating formations may comprise at least one plug and a recess. The, or each, recess may be defined by the first member and the, or each, plug may be provided on the second member. Alternatively, the, or each, recess may be defined by the second member and the, or each, plug may be provided on the first member. Preferably, the co-operating formations comprise a plurality of said plugs and recesses. Some recesses and some plugs may be provided on the first member and some recesses and some plugs may be provided on the second member. In one embodiment, the, or each, plug may be in the form of a screw, and the, or each, recess may be in the form of a threaded bore.

The co-operating formations may further include at least one further plug and recess, with the, or each, first mentioned plug and recess being arranged to attach the first side wall to the second member, and the, or each, further plug and recess being arranged to attach the central member to the second member. Preferably, the co-operating formations include a plurality of further plugs and recesses. Conveniently, the, or each, plug is in the form of a screw or a press stud.

Alternatively, the co-operating formations may be in the form of at least one rabbet and at least one corresponding elongate projection, to be received in the rabbet. The formations may include a rabbet and a projection to attach the central member to the second member, and a rabbet and a projection to attach the first side wall to the second member.

The co-operating formations may include a further rabbet in the second side wall to receive an edge portion of the second member.

The second member may be in one, two or more parts and may comprise an outer face in which may be defined grooves to receive further components of the window frame. The grooves may be provided with ribbing to assist in holding the further component in place.

According to another aspect of this invention there is provided a window frame comprising a plurality of components as described in paragraphs three to ten above connected together.

BRIEF DESCRIPTION OF THE DRAWINGS

Embodiments of the invention will now be described by way of example only with reference to the accompanying drawings, in which.

DETAILED DESCRIPTION OF THE PREFERRED EMBODIMENTS

Figure 1:
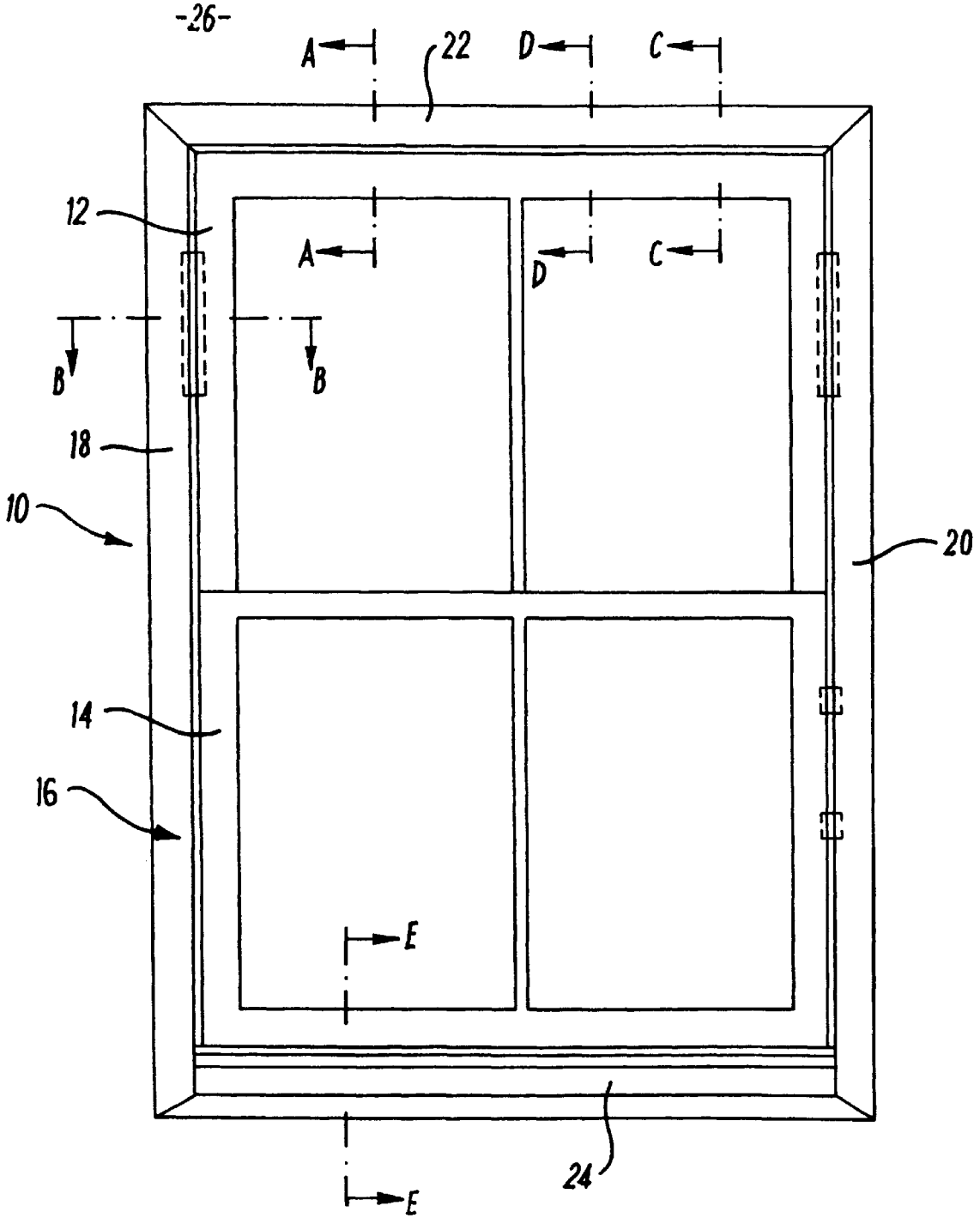
FIG. 1 is an elevated view of a window frame

Referring to FIG. 1 there is shown a box sash window frame 10 comprising an upper movable sash 12 and a lower movable sash 14. The sashes 12 and 14 are slidably mounted in a main frame 16 which comprises first and second side components 18, 20, and upper or head component 22 and a lower or sill component 24. The window frame 10 is manufactured from a suitable material such as u.P.V.C., which is mounted in brickwork 26. The components 18, 20, 22, 24 are in the form of one of two embodiments as described below.

Figure 2:
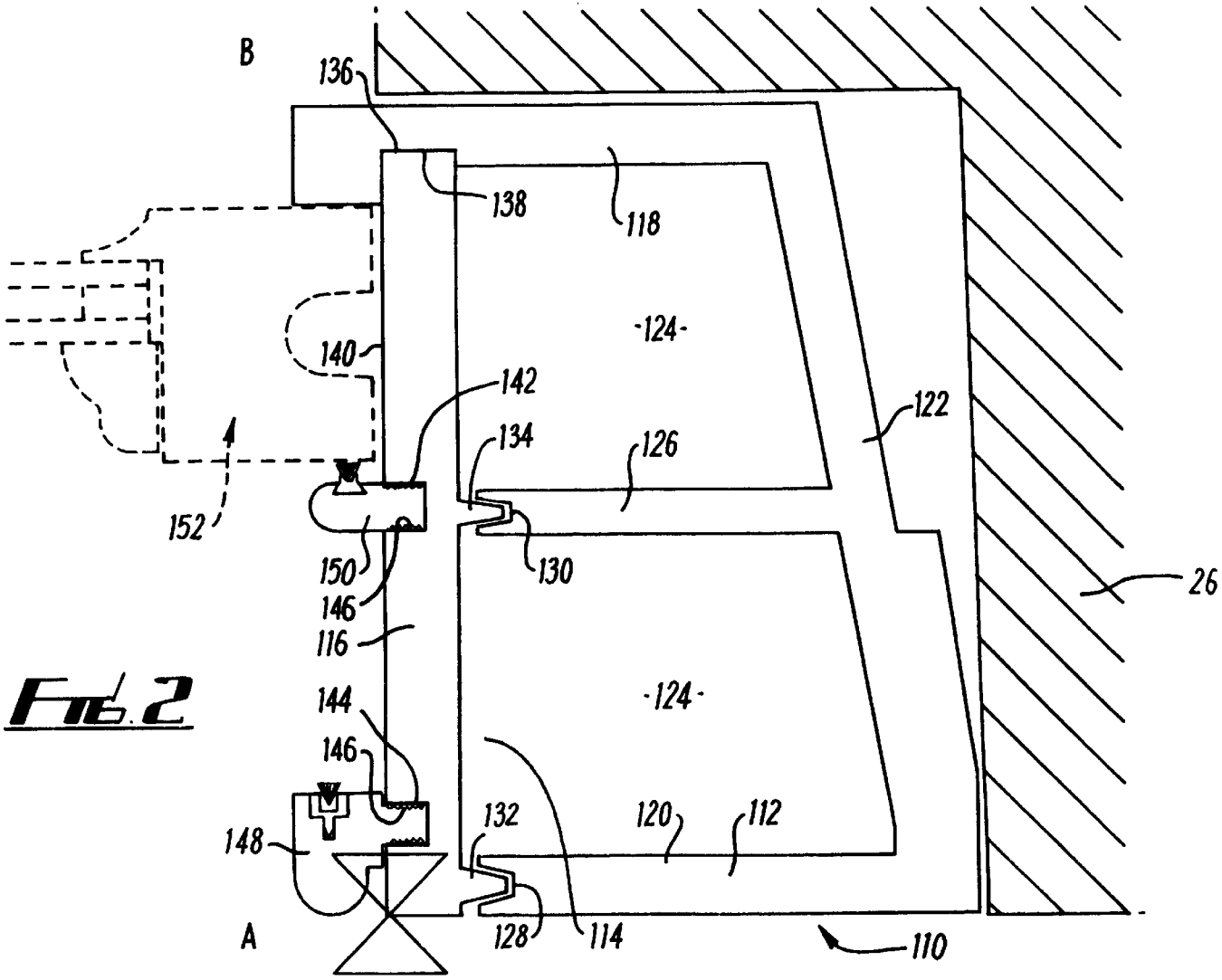
FIG. 2 is views along the lines A—A, of a first embodiment of the frame shown in FIG. 1

Referring to FIG. 2, there is shown a cross-sectional view of a component 110 of a first embodiment of the window frame 10. The component 110 comprises a first elongate member 112 having an open side 114, and a second elongate member 116 which is attached to the first elongate member 112 at the open side 114. The window frame is mounted in the brickwork 26 of a wall of a building. The brickwork 26 could be of a different configuration, if desired, to that shown in the drawing. The drawing indicates A as the inside and B as the outside of the building.

As can be seen, the first elongate member 112 has, in the view shown, substantially the shape of an E.

The first elongate member 112 comprises first and second opposite side walls 118, 120 and a rear wall 122 connected between the side walls 118, 120. As can be seen, the rear wall 122 is arranged opposite the open side 114. As can be seen in the drawing, the rear wall 122 slopes from left to right, as shown. It will be appreciated that the rear wall 122 can, if desired, slope from right to left.

The second elongate member 116 is attached to the first elongate member 112 at the open side 114 to form a closed space 124 in the component 110. The closed space 124 is divided by a central elongate member 126 fixed to the rear wall 122 and extending from the rear wall 122 to the second elongate member 116. It is an advantage of both embodiments that the central elongate member 126 acts as a strengthening means to strengthen the first elongate member 112, which enables the component 110 to be made from a material other than wood, for example a plastics material, such as u.P.V.C.

The first side wall 112 and the central elongate member 126 are provided with a plurality of spaced recesses 128, 130 respectively (only one of which is shown in each of the side wall 112 and the central elongate member 126). The second elongate member 116 is provided with studs 132, 134 adapted to be received in the recesses 128, 130 respectively. The studs 132, 134 and the recesses 128, 130 can, if desired, be replaced by a rabbet/projection combination.

The second side wall 118 defines a rabbet 136 extending the length thereof to receive an edge portion 138 of the second elongate member 116. Thus, the second elongate member is secured along three longitudinal lines to the first elongate member 112.

The second elongate member 116 defines an outer face 140 which is provided with first and second grooves 142, 144 having ribbing 146 thereon. The grooves 142, 144 are adapted to receive portions of beading 148, 150 to act as guides for other components of the window shown schematically in phantom and generally designated 152. The ribbing 146 acts to hold the beading 148, 150 in place.

In use, the component 110 is connected to other components 110 to form the square or rectangular window frame 10, having upper (head) 22, lower (sill) 24 and side components 18, 24, as shown in FIG. 1. The window frame 10 so formed is particularly suitable for use as a sash window in which the closed space 124 in the components 110 forming the side components of the frame can be used to allow the counter weights of the sashes to travel up and down.

The components 110, cut to appropriate lengths, can be used to form the opposite side elements 18, 20 of the frame 10 and the upper and lower components 22, 24. With the exception of the lower component 24, the face 140 of the second elongate member 116 faces inwardly in all the components of the frame so formed. In the case of the lower component 22 of the frame 10, the rear wall 122 can be used to form the window sill. Alternatively, the bottom component of the frame could be so arranged that the face 40 of the second elongate member 16 faces inwardly of the frame, and an appropriate wooden plank, or other suitable member can be cut to form the window sill. Alternatively, a component 22 having a different profile can be formed.

Various modifications can be made without departing from the scope of the invention, for example, the shape of the component, in particular the first elongate member can be any appropriate shape. Also, the open side 14 of the elongate member 12 could be defined along the side occupied by side wall 20. Alternatively, the open side 14 could be defined along part of either or both of the present position of open side 14 and of the side wall 20. In another modification, the central elongate member 26 may not be fixed to the rear wall 22. In a further modification, the rabbet 36 could be replaced by a plurality of studs and/or sockets to fix the second elongate member 16 to the side wall 18. It will be appreciated that any suitable securing means to secure the second elongate 16 to the side wall 18.

Referring to FIGS. 3 to 7, there is shown a second embodiment of the window frame 10 generally represented in FIG. 19 which is of similar construction to the embodiment shown in FIG. 1, but there are a number of differences which will become apparent in the description below.

Figure 3:
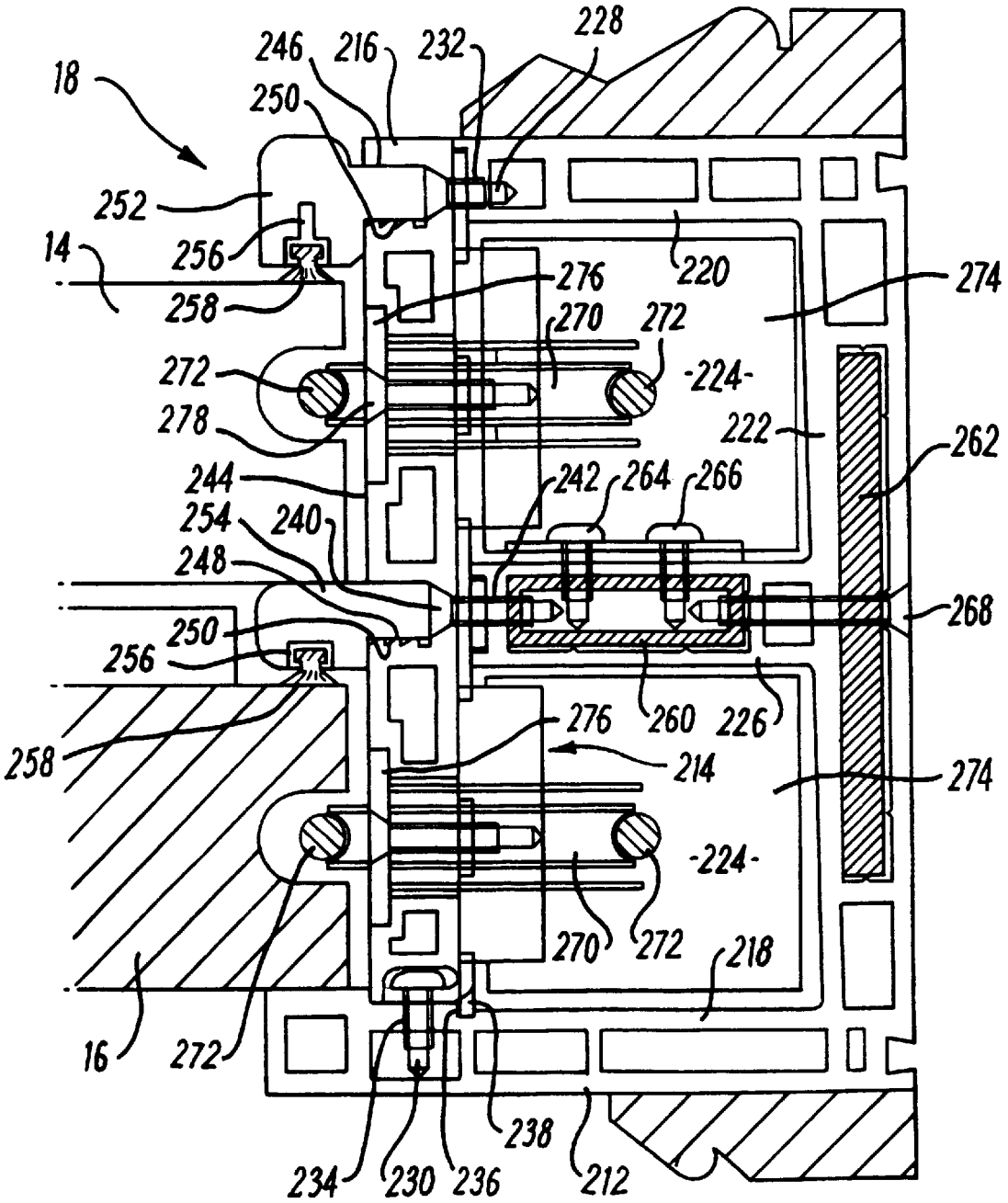
FIGS. 3 to 6 are views along the lines B—B, C—C, D—D, and E—E respectively of a second embodiment of the frame shown in FIG. 1.

In FIG. 3 the side component 18 is shown. It will be appreciated that the construction of the side component 20 will be the same, but a mirror image of the side component 18.

The side component 18 comprises a first elongate member 212 in the form of a first u.P.V.C. profile substantially in the shape of an E, having an open side 214, and a second elongate member 216 in the form of a second u.P.V.C. profile. The first and second elongate members 212, 216 can be formed by a known moulding process.

The first elongate member 216 comprises first and second opposite side walls 218, 220 and a rear wall 222 connected between the side walls 218, 220.

The second elongate member 216 is attached to the first elongate member 212 at the open side 214 to form a closed space 224. The closed space 224 is divided by a central elongate member 226 fixed to the rear wall 222 and extending transversely therefrom, as shown. In the embodiment shown, the central elongate member 226 is integrally attached to the rear wall 222 and is formed therewith during the moulding process.

The second elongate member 216 is connected to the first elongate member 212 by means of a plurality of screws 228, 230 adapted to be received in correspondingly threaded recesses 232, 234. The screws 228, 230 and the recesses 232, 234 are spaced along the length of the first and second members 212, 216.

The first side wall 218 is longer than the second side wall 220, whereby the second elongate member 216 is attached to the first elongate member 214 at the side of the first wall 218 and at the other end of the second wall 220, as shown The first side wall 218 defines a rabbet 236 extending the length thereof to receive and locate therein an edge portion 238 of the second elongate member 216.

The second elongate member 216 is further attached to the first elongate member at the central elongate member 226 by means of a plurality of screws 240 received in a plurality of correspondingly threaded recesses 242 spaced along the length of the second elongate member 216 and the central elongate member 226.

The second elongate member 216 has an outer face 244 defining first and second grooves 246, 248 having ribbing 250 formed therein, in which beading 252, 254 respectively extend substantially the length of the second member 216. Each beading 252, 254 defines along its length an elongate recess 256 into which is received an elongate sealing element or strip 258 to engage the movable sashes 12, 14.

The first elongate member 212 is provided with the first and second reinforcements 260, 262. The first reinforcement 260 is secured to the central member by the screws 240 securing the second member 216 to the central member 226. Further screws 264, 266 further secure the first reinforcement 260 to the central member 226 and are provided at the side thereof, as shown.

The second reinforcement 262 is provided in the rear wall 222 and is secured therein by a plurality of screws 268 extending through the rear wall 222 and the second reinforcement 262. The screws 268 also assist in securing the first reinforcement 260 in the central member 226.

Each side of the space 224 is provided with a pulley 270 attached to the second member 216. Each pulley 270 has a length of rope 272 or other suitable material passed thereover which is attached at one end to a balance weight 274 and at the other end to the respective sashes 14, 16 to allow the sashes 14, 16 to be raised or lowered as desired. For the sake of clarity, the portion of the rope 272 passing over the pulleys 270 has been omitted. The pulleys 270 are mounted on brackets 276 and secured to the second elongate member by screws 278.

Figure 4:
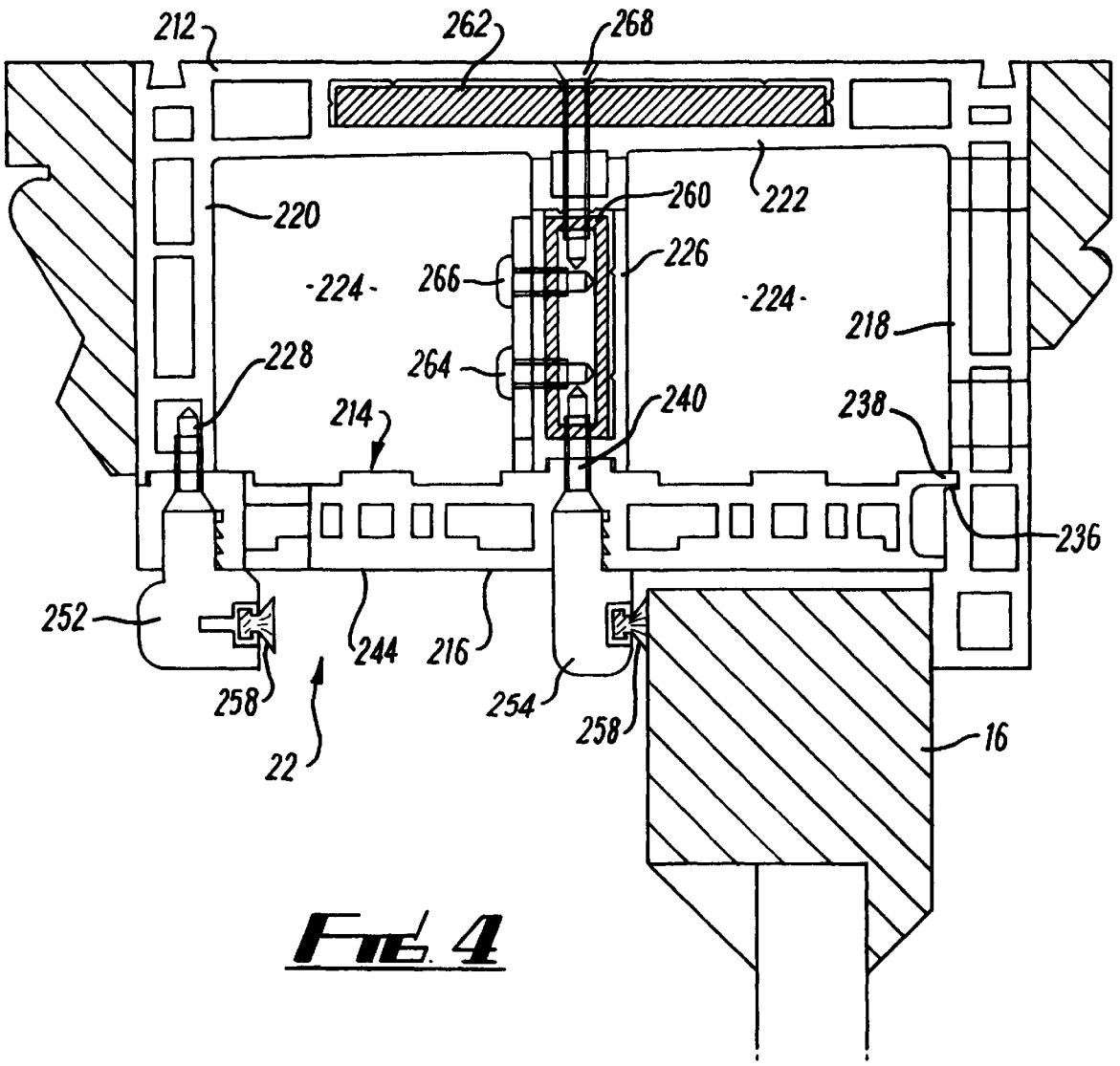

Referring to FIG. 4 there is shown a sectional view of the upper or head component 22, which comprises all the features of the side components 18 described above and these have been designated with the same reference numerals.

Figure 5:
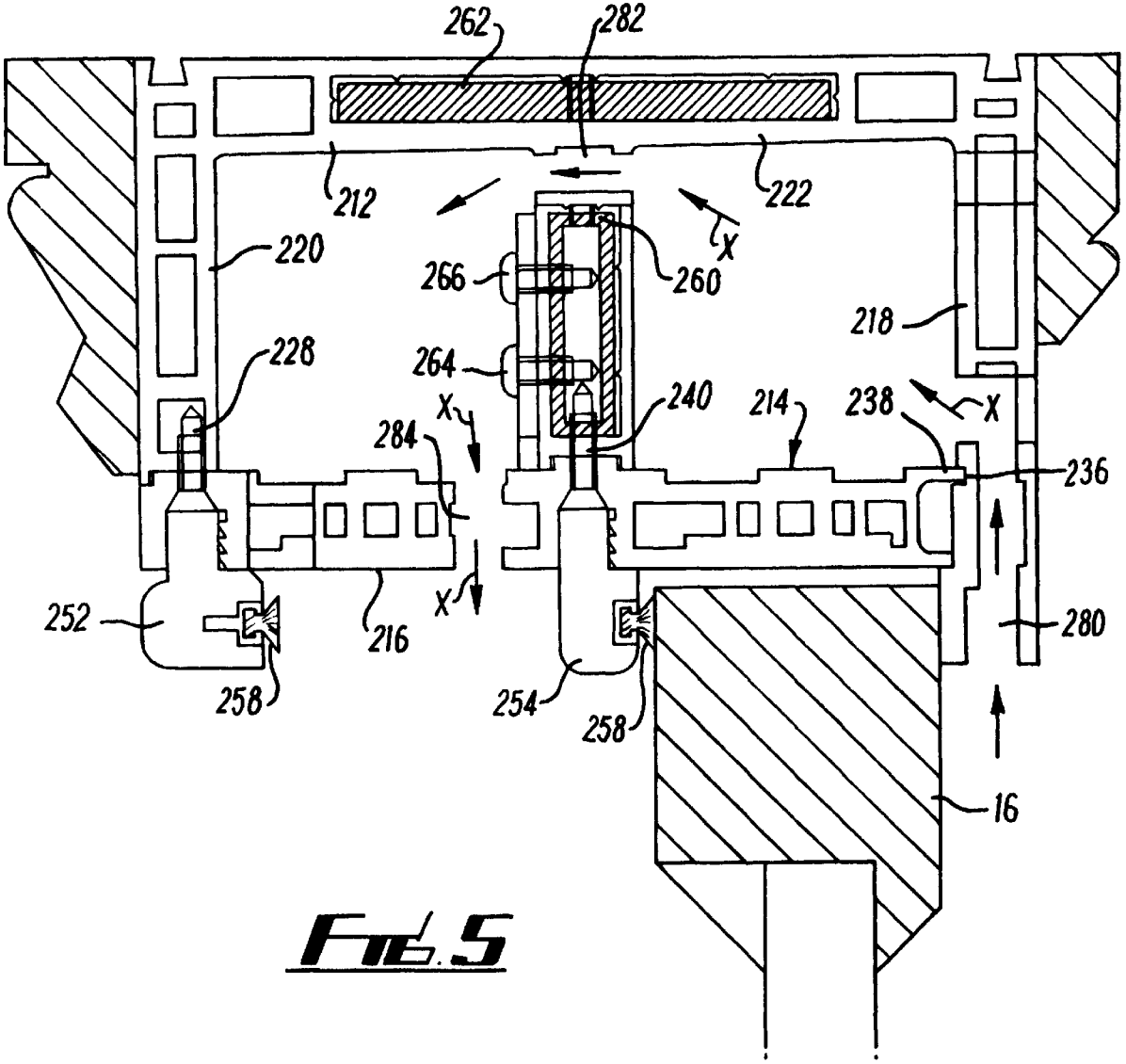

FIG. 5 shows a view of the head component 22 at a different position and shows the ventilation path designated by the arrows X through the head section as defined by apertures 280, 282 and 284 formed in the side wall 218, the central member 226 and the second elongate member 216, as shown.

Figure 7:
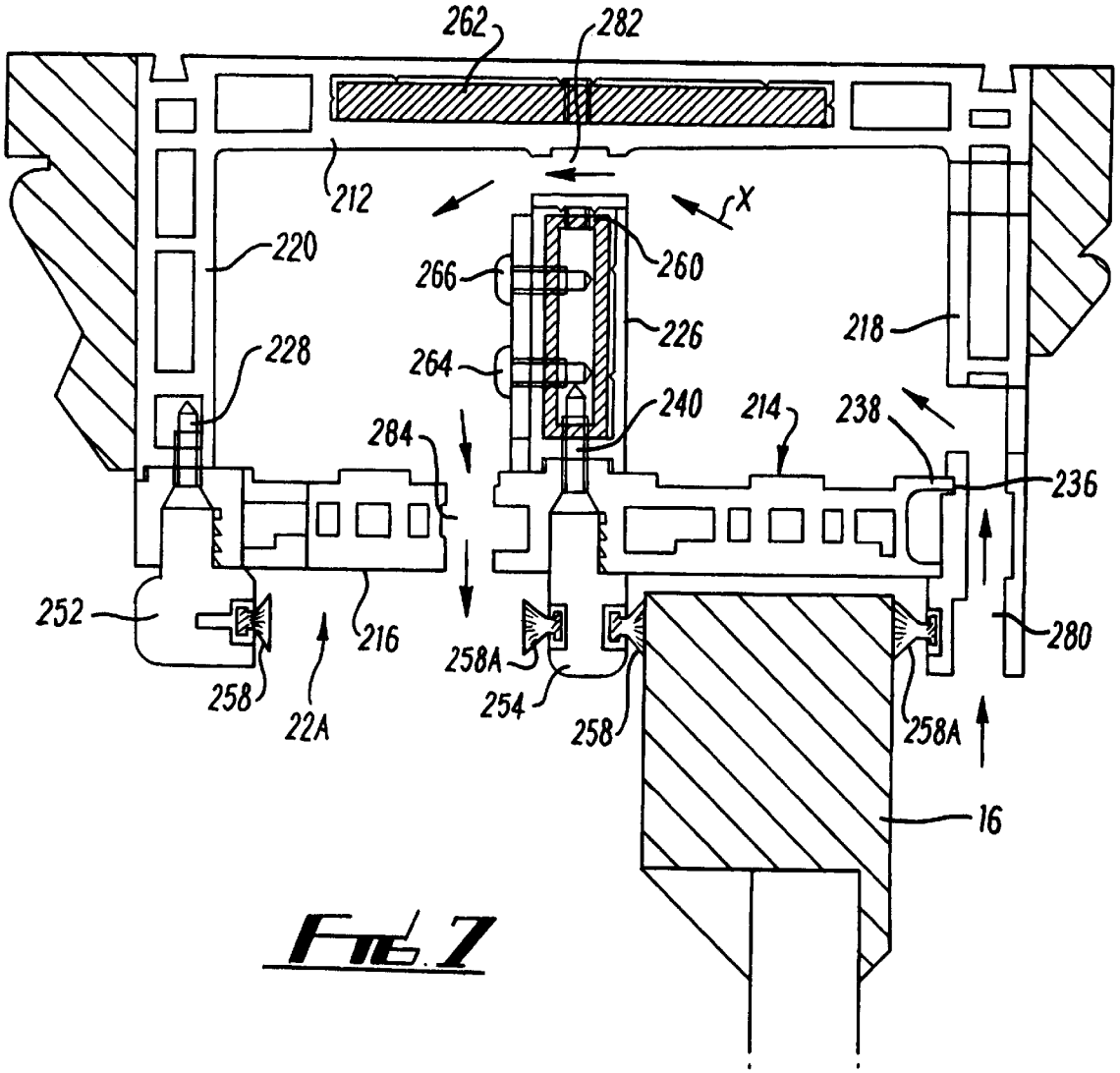
FIG. 7 is a view along the lines D—D of a modified version of the second embodiment.

Referring to FIG. 7, there is shown an alternative embodiment of the head component 22 designated 22A in this Fig, which is generally the same as the head component 22 but which differs only in the provision of further sealing strips 258A so that the sashes 14, 16 are engaged on each side. It will be appreciated that these further sealing strips 258A can be provided on the side components 18 and 20. It will also be appreciated that the number and position of sealing strips 258, 258A can be varied as desired.

Figure 6:
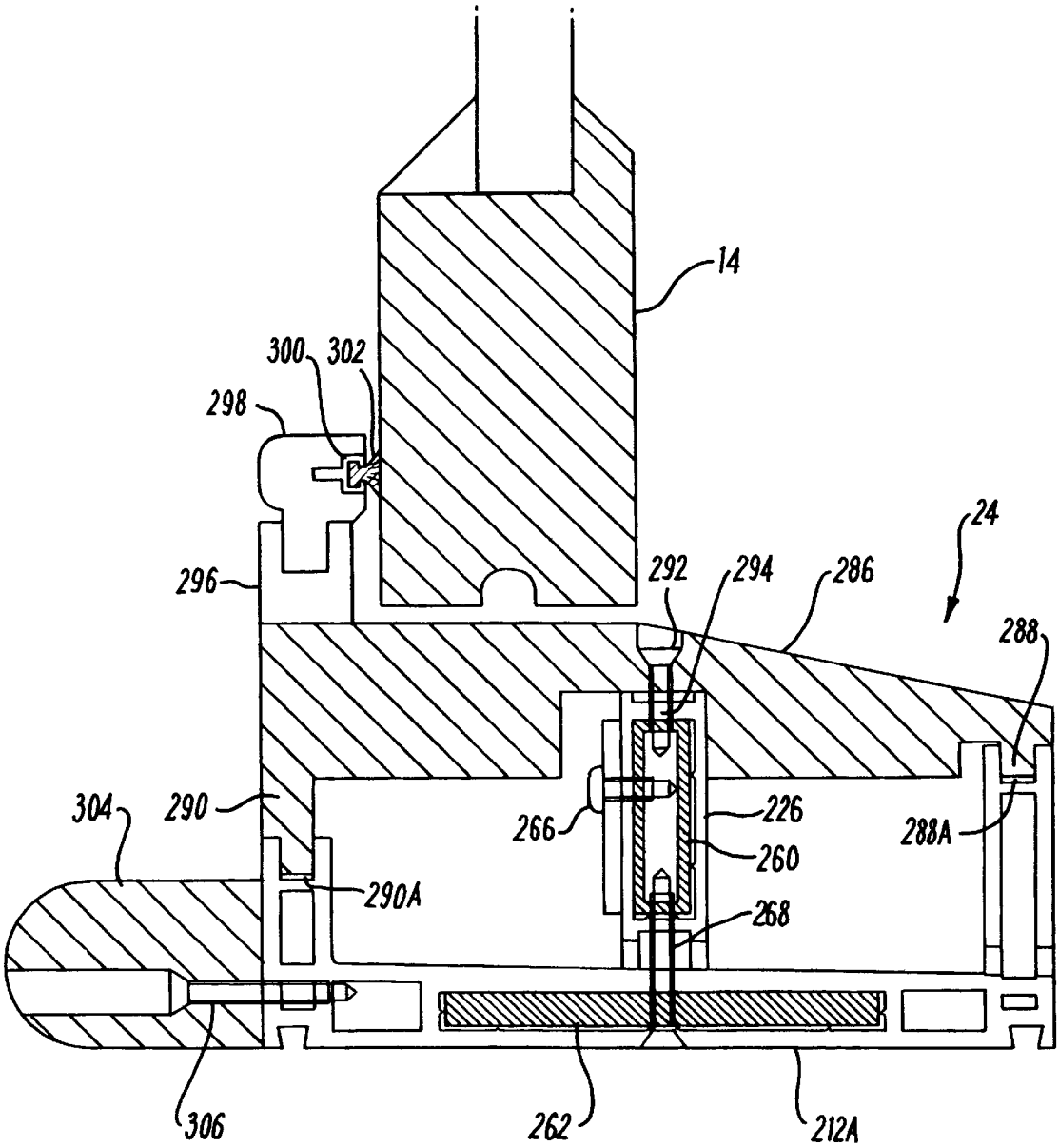

Referring to FIG. 6 there is shown a sectional view of the lower or sill component 24 but comprises a first elongate member 212A, which differs in configuration to the elongate member 212. The sill component 24 further includes a sill 286 to replace the elongate member 216 used in the other components. The sill 286 can be formed of wood, or other suitable material.

The sill 286 is provided with projections 288, 290 to engage in corresponding recesses 288A, 290A in side walls 218, 220A of the first elongate member 212A. The sill 286 is secured to the second elongate member 212A by a plurality of screws 292 threadably received in a plurality of recesses 294 along the central member 226.

The first elongate member 212A is provided with reinforcements 260, 262 which are secured thereto in the same way as the reinforcements described in FIG. 3.

A sill bead 296 is provided on the sill and this carries a beading 298. The beading 298 defines an elongate recess 300 in which is received a sealing strip 302 to engage the lower sash 16.

A weather bar 304 is provided on the outside of the sill component 22 and is secured to the first elongate member 212A by a plurality of screws 306.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A component for a sash window frame having a pulley, cord and weight arrangement, the component comprising a first elongate member defining an open side so defined to face outwardly from a wall in which the component is to be mounted, the first elongate member including first and second opposite side wall members and a rear wall member from which the side wall member extend, the wall members being arranged such that the open side is opposite the rear wall member, a second elongate member provided on the open side to define with said first elongate member a substantially closed space in which said pulley, cord and weight arrangement can be received, a plurality of pairs of cooperating formations spaced along the first and second elongate members, each pair of co-operating formations being in the form of a projecting element selected from the group comprising plugs and screws provided on one of the first and second elongate members, and said pair further including a recess defined by the other of the first and second elongate members to receive the protecting element, wherein the co-operating formations are provided to attach the first elongate member to the second elongate member, whereby when the first and second elongate members are attached to each other by the co-operating formations, the first and second elongate members are substantially incapable of movement relative to each other, and wherein the component includes a plurality of ventilating apertures therein to define a ventilation path therethrough.

2. A component according to claim 1, wherein the recesses are defined by the first member and the projecting elements are provided on the second member.

3. A component according to claim 2, wherein there are further co-operating formations including at least one further element selected from the group comprising plugs or screws and a recess, with each first mentioned cooperating formation being arranged to attach the first side wall to the second member, and each further cooperating formation being arranged to attach a central member to the second member.

4. A component according to claim 1, wherein the apertures are formed in the first member, the second member and the central member to define said ventilation path.

5. A component according to claim 1 wherein the first elongate member further includes a central elongate member extending from said rear wall to a position near the second member when the second member is attached to the first member.

6. A component according to claim 5 wherein the side walls and the central member are substantially parallel to each other.

7. A sash window comprising:

a frame including head and sill frame portions and a pair of oppositely arranged edge portions provided between the frame and the sill members;

a sash slidably mounted in the frame;

the window being adapted to be mounted on an opening in a wall;

each edge frame portions including a first elongate member defining an open side so defined to face outwardly from such wall against which the first member is to be mounted, the first elongate member including first and second opposite side wall members, and a rear wall member from which the side wall members extend, the wall members being arranged such that the open side is opposite the rear wall member, and a second elongate member provided on the open side to define with said first elongate member a substantially closed space;

a pulley, cord and weight arrangement in said closed space to control movement of the sash;

a plurality of pairs of co-operating formations spaced along the first and second elongate members, each pair of co-operating formations being in the form of a projecting element selected from the group comprising a plug and a screw provided on a selected one of the first and second elongate members; and each said pair of co-operating formations further including a recess defined by the other of the first and second elongate members to receive the projection, wherein the co-operating formations are provided to attach the first elongate member to the second elongate member whereby when the first and second elongate members are attached to each other by the co-operating formations, the first and second elongate members are substantially incapable of movement relative to each other; and wherein at least one of the members includes a plurality of apertures therein to define a ventilation path through the component.

8. A window according to claim 7, wherein the first elongate member further includes a central elongate part extending from said rear wall to a position adjacent to, or in contact with, the second member when the second member is attached to the first member.

9. A window according to claim 8, wherein the side walls and the central part are substantially parallel to each other.

10. A window according to claim 7, wherein the recesses are defined by the first member and the projections are provided on the second member.

11. A window according to claim 10, wherein further co-operating formations are provided including at least one further recess and a selected one of a plug and a screw, the first mentioned co-operating formations being arranged to attach the first side wall to the second member, and the further co-operating formations being arranged to attach the central part to the second member.

12. A window according to claim 7, wherein the apertures are formed in the first member and the second member and the first member includes a central part including further apertures to define said ventilation path.

* * * * *